US006701641B2

(12) United States Patent
Tung

(10) Patent No.: US 6,701,641 B2
(45) Date of Patent: Mar. 9, 2004

(54) LINING FOR WATERPROOF SHOE

(76) Inventor: Chia-Ho Tung, No. 192, Sha Tien Rd., Sha Lu Chen, Taichung Hsien (TW)

( * ) Notice: Subject to any disclaimer, the term of this patent is extended or adjusted under 35 U.S.C. 154(b) by 70 days.

(21) Appl. No.: 10/087,749

(22) Filed: Mar. 5, 2002

(65) Prior Publication Data

US 2003/0167656 A1 Sep. 11, 2003

(51) Int. Cl.[7] ..... A43B 23/07
(52) U.S. Cl. ..... 36/55; 36/10; 36/12
(58) Field of Search ..... 36/10, 12, 55

(56) References Cited

U.S. PATENT DOCUMENTS 4,180,872 A * 1/1980 Chaikin ..... 623/55
4,809,447 A * 3/1989 Pacanowsky et al. ..... 36/9 R
4,967,494 A * 11/1990 Johnson ..... 36/9 R
5,285,546 A * 2/1994 Haimerl ..... 12/142 E
5,426,869 A 6/1995 Gore et al.
5,499,459 A * 3/1996 Tomaro ..... 36/10
6,088,935 A * 7/2000 Pavelescu et al. ..... 36/14
6,446,360 B1 * 9/2002 Sheets et al. ..... 36/55
6,474,001 B1 * 11/2002 Chen ..... 36/55

FOREIGN PATENT DOCUMENTS

GB 2264626 * 9/1993

* cited by examiner

*Primary Examiner*—M. D. Patterson
(74) *Attorney, Agent, or Firm*—Browdy and Neimark, P.L.L.C.

(57) ABSTRACT

An inner lining for waterproof shoe includes a lining body made of waterproof material which has a full side wall forming a complete enclosure except for the top and bottom, the body being made to conform to the shape and size of the interior of the shoe; an insole board with its edge connected with the lower end of the side wall of the body; a bridging strip made of waterproof material having an upper end joined to the lower end of the side wall and a lower end that is turned back so that the strip encloses the seam of the body and forms a folded portion below the under side of the insole board; and the contact surfaces between the strip, the side wall and the insole board being sealed.

6 Claims, 3 Drawing Sheets

LINING FOR WATERPROOF SHOE

FIELD OF THE INVENTION

The present invention relates to a waterproof shoe, and more particularly to an improved lining for waterproof shoe.

BACKGROUND OF THE INVENTION

Waterproof shoes with a shoe structure which includes a lining having waterproof and wearing comfort functions are widely known. The lining described in U.S. Pat. No. 5,426,369 (as shown in FIG. 1) is an improvement. The lining in that case includes a body 1 and an insole board 2. The lower end area of the body is turned back to form a folded portion 3 adhering to the under side of the insole board 2. In such constructions the folded portion 3 must be made in several pleats, specially in the area corresponding to the frontmost part of a foot, to be easily adhered to the under side of the insole board 2. However, it will cause the user's foot to feel uncomfortable, since the front space of the lining which is used to receive the toe of a foot is narrowed. Further, the folded line 4 is a stress concentrating position so that it is easily torn when using a period of time. This means that water can penetrate along the folded line to the inside of the lining. In addition, when the material that the lining used is made thicker, the processes to turn back the lower end area of the lining to form the folded portion 3 adhering to the insole board 2 becomes difficult. And in such conditions, the numbers of interstices between the pleats formed in the folded portion 3 are increased. Water which penetrates the shoe will then easily creep along the interstices into the inside of the lining.

SUMMARY OF THE INVENTION

It is therefore the primary objective of the present invention to provide an improved lining for waterproof shoe which can be manufactured more simply and economically.

It is another objective of the present invention to provide an improved lining for waterproof shoe which is more comfortable than prior art in wearing.

It is still another objective of the present invention to provide an improved lining having a waterproof function of which is better than prior art.

In carrying out the objectives of the invention, the lining of the invention has a lining body made of waterproof material which has a full side wall forming a complete enclosure except for the top and bottom, said body being made to conform to the shape and size of the interior of the shoe. An insole board with the edge thereof is connected with the lower end of the side wall of said body. A bridging strip made of waterproof material has an upper end that is joined to the lower end of said side wall of said body, and a lower end that is turned back in such a manner that said strip encloses the seam of said body and forms a folded portion below the under side of said insole board. The contact surfaces between said strip, said side wall of said body and said insole board being sealed.

The invention will be better understood and additional objectives and advantages will become apparent from the following description taken in connection with the accompanying drawings.

DETAILED DESCRIPTION OF THE INVENTION

Figure 1:
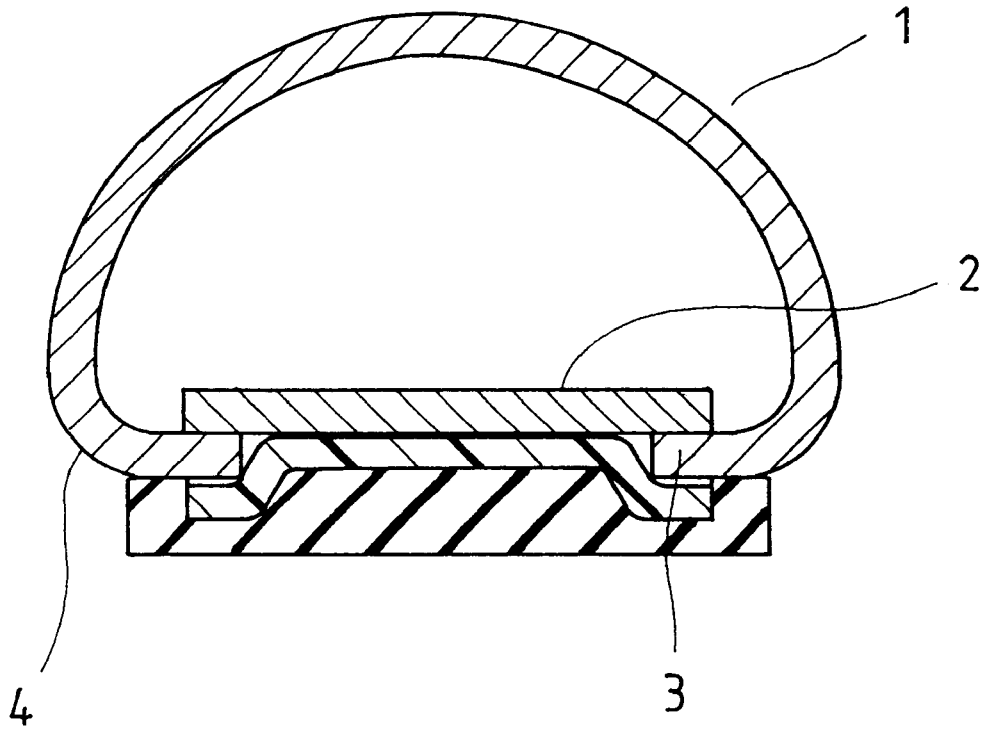
FIG. 1 PRIOR ART
FIG. 1 is a sectional view of a conventional lining for waterproof shoe.
Figure 2:
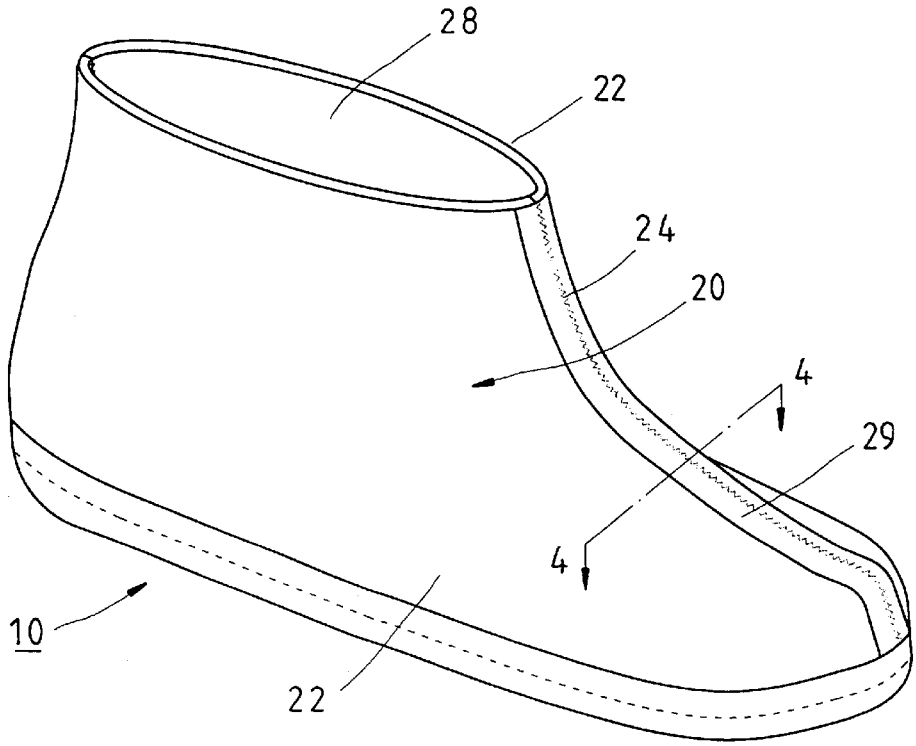
FIG. 2 is a perspective view of a lining of the present invention.
Figure 3:
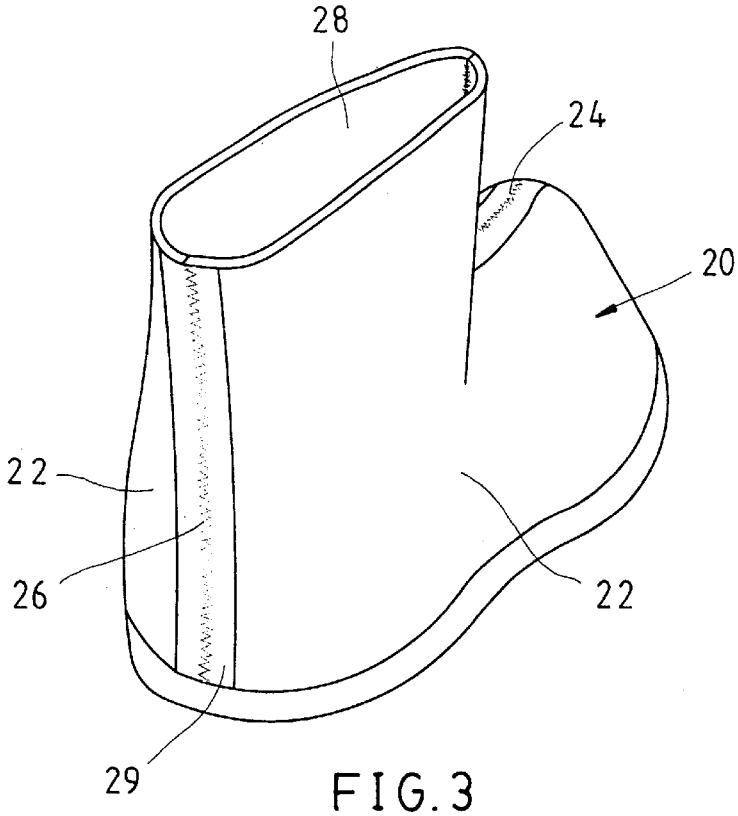
FIG. 3 is a behind view of the lining as shown in FIG. 2.
Figure 4:
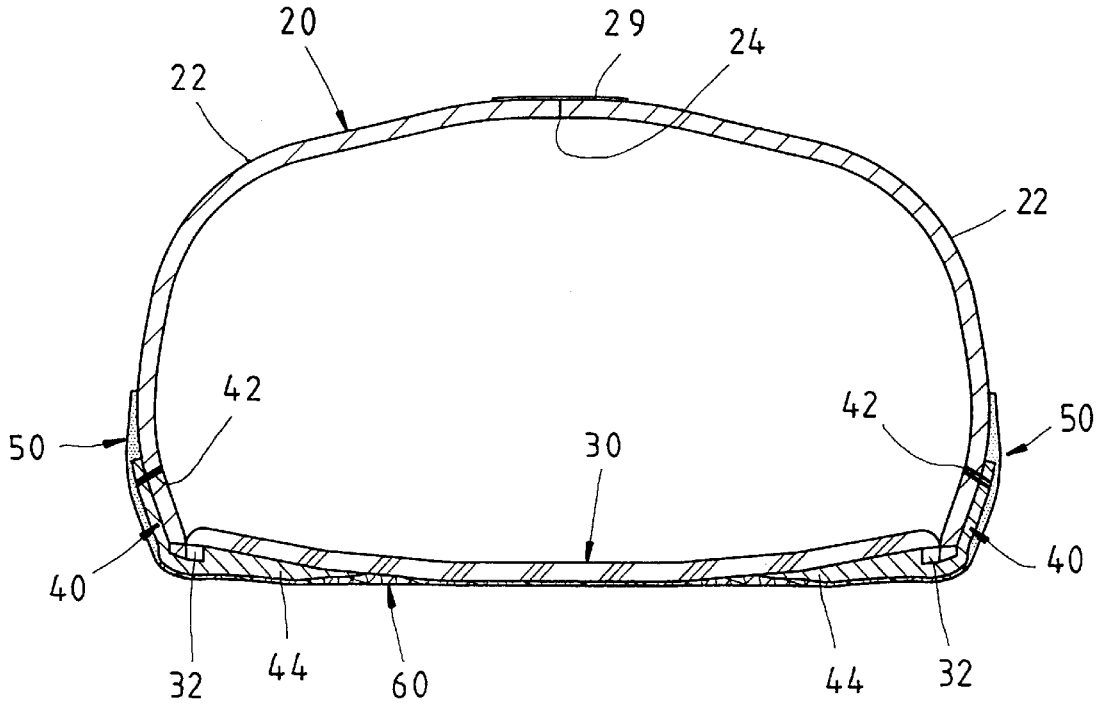
FIG. 4 is a sectional view looking at the section 4—4 of FIG. 2.

As shown in FIG. 4, a lining embodied in the present invention 10 comprises a lining body 20, and insole board 30, a bridging strip 40, waterproof tape 50 and an insole gasket 60.

The lining body 20 is made of a waterproof construction. It can be leather or canvas usually with a soft fabric backing; or, it can be a laminate in which one layer comprises a waterproof, breathable membrane. In producing, the lining body 20 is formed by sewing two symmetry pieces 22 together. Each said piece 22 is cut out from the material mentioned above. The seams of the two pieces are indicated by the numerals 24 and 26. The lining body 20 has a full side wall forming a complete enclosure except for the top and bottom. The lining body 20 is made to conform to the shape and size of the interior of the shoe and has a top opening 28 to allow the user's foot to enter the space defined thereby. In addition, the outersurfaces of the seams 24 and 26 are sealed by a waterproof tape 29.

Figure 5:
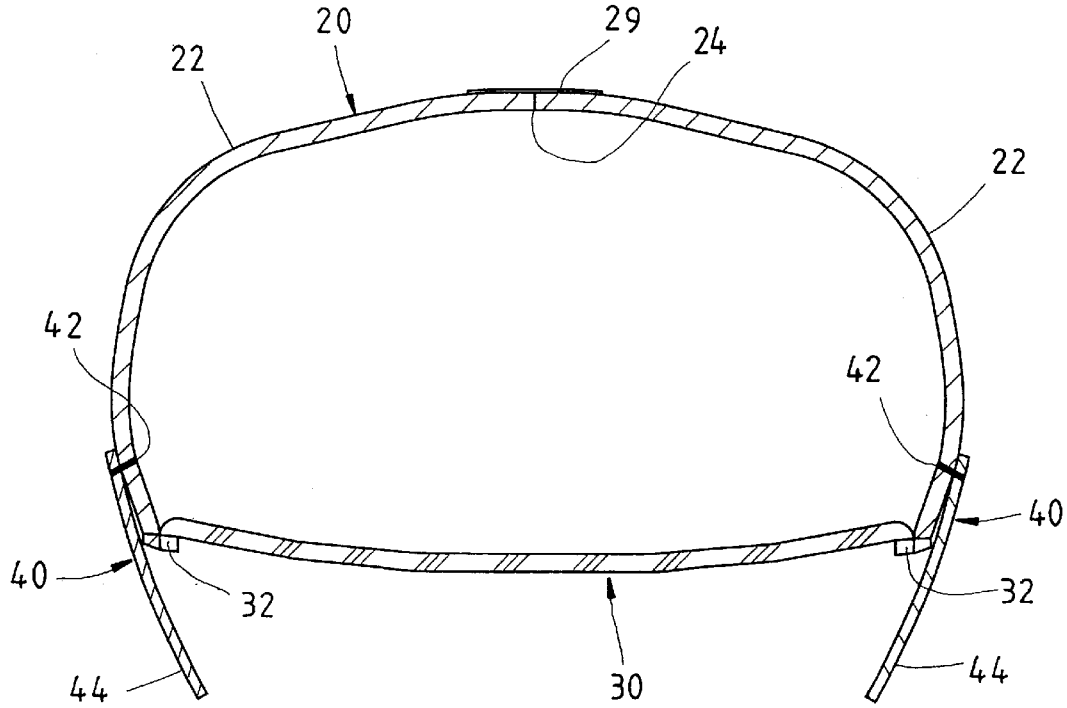
FIG. 5 is the same view as FIG. 4 but only depicts the lining body and the bridging strip.

As shown in FIGS. 4 and 5, the lower end of the lining body 20 is sewed on the terminated edge of the insole board 30. The seam of the two parts mentioned above is indicated by the numeral 32. The bridging strip 40 is made of a laminate in which one layer comprises a waterproof membrane and has a predetermined width. The upper end of the bridging strip 40 is sewed on the lower end of the side wall of the lining body 20. The seam of the two parts is indicated by the numeral 42. The lower end of the bridging strips 40 is turned back in such a manner that the bridging strip 40 encloses the seam 32 and forms a folded portion 44 below the under side of the insole board 30. The contact surfaces between the bridging strip 40, the side wall of the lining body 20 and the insole board 30 are adhered together. The production of the lining construction mentioned above is operated on a shoe last to which the lining body 20 is attached.

In addition, for getting a better waterproof effect, the outersurfaces of the seam 42 is sealed by a waterproof tape 50 and an insole gasket 60 is adhered to the under surfaces of the folded portion 44 of the bridging strip 40 and the insole board 30.

The advantages of this new lining are numerous. The front space of the lining which is used to receive the toe of user's foot will not be narrowed since the lower end area of the lining body need not turn back to form a folded portion adhering to the under side of the insole board. The thickness of the lining body will not have any ill effects to the producing process of the lining. The shortcoming of the conventional lining having a folded line easily torn will be overcome since there is no folded line on the lining body but on the bridging strip, and the bridging strip can be made of a material having a tensile force stronger than the material of which the lining body is made.

What is claimed is:

1. An inner lining for a waterproof shoe comprising:

a lining body made of waterproof material which has a full side wall forming a complete enclosure except for the top and bottom, said body being made as a continuous integral sheet which conforms to the shape and size of the interior of the shoe;

an insole board with the edge thereof sewn to the lower end of the side wall of said body to form a raised seam on an exterior of the engaged lining body and insole board;

a bridging strip made of waterproof material having an upper end that is joined to the lower end of said side wall of said body and a lower end that is turned back to enclose the raised seam and forms a portion folded below the underside of said insole board; and wherein contact surfaces between said strip, said side wall of said body and said insole board are sealed.

2. The inner lining as recited in claim 1, wherein a seam area of the upper end of said bridging strip and the side wall of said lining body is sealed by a waterproof tape.

3. The inner lining as recited in claim 1, further comprising an insole gasket adhered to the under surfaces of said folded portion of said bridging strip and said insole board.

4. The inner lining as recited in claim 1, wherein said lining body is formed by two symmetry pieces combined together.

5. The inner lining as recited in claim 1, wherein the upper end of said bridging strip is sewn on the lower end of said side wall of said body.

6. The inner lining as recited in claim 1, wherein the edge of said insole board is sew on the lower end of the side wall of said body.

* * * * *